US007062887B1

(12) United States Patent
Holdren

(10) Patent No.: US 7,062,887 B1
(45) Date of Patent: Jun. 20, 2006

(54) INTERSECTING STRUCTURAL MEMBER AND A METHOD FOR JOINING SAME

(75) Inventor: Richard L. Holdren, Columbus, OH (US)

(73) Assignee: Edison Welding Institute, Columbus, OH (US)

( * ) Notice: Subject to any disclaimer, the term of this patent is extended or adjusted under 35 U.S.C. 154(b) by 0 days.

(21) Appl. No.: 10/417,958

(22) Filed: Apr. 17, 2003

(51) Int. Cl.
*E04C 2/42* (2006.01)
*B63B 9/06* (2006.01)

(52) U.S. Cl. ..... 52/653.1; 52/664; 52/669; 52/737.2

(58) Field of Classification Search ..... 52/653.1, 52/737.2, 664, 665, 669, 506.1; 403/279, 403/282, 353, 331, 381
See application file for complete search history.

(56) References Cited

U.S. PATENT DOCUMENTS

| | | | | | |
|---|---|---|---|---|---|
| 1,272,809 | A | | 7/1918 | Johnson | |
| 1,346,426 | A | * | 7/1920 | Scherbner | 52/667 |
| 1,603,678 | A | * | 10/1926 | Furey | 52/667 |
| 1,805,669 | A | | 5/1931 | Liamin | |
| 1,821,882 | A | | 9/1931 | Curr | |
| 1,837,078 | A | | 12/1931 | Smith | |
| 1,922,063 | A | | 8/1933 | Vaughn | |
| 2,158,214 | A | | 5/1939 | Bester | |
| 2,162,822 | A | | 6/1939 | Parsons | |
| 2,404,570 | A | * | 7/1946 | Elliott | 52/667 |
| 2,644,418 | A | | 7/1953 | Allegro | |
| 4,211,381 | A | * | 7/1980 | Heard | 248/230.8 |
| 4,214,332 | A | | 7/1980 | Stoner | |
| 4,310,132 | A | | 1/1982 | Robinson et al. | |
| 5,784,850 | A | * | 7/1998 | Elderson | 52/667 |
| 5,806,797 | A | | 9/1998 | Micale | |
| 6,131,354 | A | * | 10/2000 | Thompson | 52/511 |
| 6,364,250 | B1 | | 4/2002 | Brinck et al. | |
| 6,694,695 | B1 | * | 2/2004 | Collins et al. | 52/568 |

* cited by examiner

*Primary Examiner*—Peter M. Cuomo
*Assistant Examiner*—Joe Edell
(74) *Attorney, Agent, or Firm*—Gallagher & Dawsey Co., LPA; Michael J. Gallagher; David J. Dawsey

(57) ABSTRACT

An intersecting structural member, and a method for assembling the same, allowing continuous structural members to intersect while also allowing one edge of each of the structural members to be bonded to a skin panel. A first structural member is provided with at least one bendable tab that allows an ingress area in the first member to be opened to permit the passage of a second structural member. The at least one bendable tab may optionally be designed in various shapes, with or without material reducing regions, may then be closed, interlocking the members and producing the intersecting structural member. This structure and method may be used to eliminate the need for welding collars around the member intersections, reducing labor, materials, weight, complexity of joining, and improving resistance to metal fatigue at the intersections.

23 Claims, 7 Drawing Sheets

INTERSECTING STRUCTURAL MEMBER AND A METHOD FOR JOINING SAME

STATEMENT REGARDING FEDERALLY SPONSORED RESEARCH OR DEVELOPMENT

This invention was made with government support under Contract No. N00140-96-C-0188, Navy Joining Center Project No. TDL01-06 awarded by the Office of Naval Research (ONR) and Contract N00014-02-C-0106, Navy Joining Center Clin 04, awarded by the Office of Naval Research (ONR). The government has certain rights in the invention.

TECHNICAL FIELD

The present invention relates to the field of structural joining; particularly, to a method of joining two structural members, when both members run continuously across at least one intersection.

BACKGROUND OF THE INVENTION

Ironworkers and structural assembly persons have long recognized the need for an intersecting structural member that allows some degree of flexibility in assembly, while reducing the additional time spent securing the structural members created by the desired flexibility in assembly. Such long-felt needs have been particularly prevalent in the fields of ship and aircraft construction.

Many structures, such as those identified above, are constructed of a relatively thin skin material supported by underlying structural members that intersect in some combination of angles. An optimal design would allow for bonding of the structure's skin continuously along one edge of all the underlying structural members, and would allow all of the structural members to run continuously, that is, to not be interrupted at the points where the members intersect. However, a problem is created at each intersection of these structural members. The members generally intersect in one of three ways. Either the members must overlap, one member must pass through an aperture in the other, or one member must be discontinuous, that is, it must be interrupted and be joined to the sides of the other member. Numerous attempts have been aimed at improving the joints created by the intersection of these members.

The first method, that of overlapping intersecting structural members, is taught in U.S. Pat. No. 4,214,332 to Stoner. In the '332 method, continuous cross members are laid on top of continuous longitudinal members, and the members are fastened at each intersection. Such a technique allows for easy assembly, as there is a relatively large tolerance allowable in selecting the joining points. The technique also allows for the strength of two uninterrupted structural members, but prevents the skin of the structure from lying tightly against both members, as the members do not lie in the same plane. As the structural members are not coplanar, the structure's skin may be fastened to only one set of structural members. In the '332 patent, teaching a method of building a boat, the structural members run approximately longitudinally and transversely in the boat hull, and the skin is fastened to the longitudinal members. Accordingly, a gap is produced between the vessel's skin and all of the transverse members.

The second method of intersecting structural members involves passing one structural member through an aperture in another structural member in a generally notching method of assembly, and can be seen to fall into two general classes; tight and non-tight joining.

Tight joining may be defined as that where the aperture (notch) and the member to fit within it are extremely close to one another in shape and size, so that the structural members fit somewhat tightly together, and the fastening of the two, by such means as adhesives, soldering, brazing, or welding, essentially closes any gap between the structural members to be joined. Tight joining has the advantage of it being relatively easy to close the gap between the structural members, as the gap is small and the fastening method substantially or completely closes the gap. Because the gap between structural members is filled by the bonding material, connections between the structural members are intrinsically waterproof, or nearly so. It has the disadvantage of requiring very close manufacturing and assembly tolerances, and careful craftsmanship in assembly, all of which increase costs and complexity, and are especially difficult to achieve in shipbuilding or other applications where large components are being fabricated.

Non-tight joining may be defined as that where the aperture and the member to fit within it are considerably different in shape and size, that is, the member being considerably smaller than the aperture, so that the intersecting structural members fit only loosely together when they are assembled. This loose fit makes it relatively difficult to close the gap between the structural members, and an additional piece or pieces, called a collar, is traditionally fixed around the aperture to secure the members and close the gap. Non-tight joining has the advantage of being relatively easy to assemble, as there are large tolerances allowable in the fit between the members.

It has the disadvantage of requiring a third (and sometimes more) piece, the collar, to secure the joint between the members. Securing structural members with collars requires a plurality of collars in typical construction, leading to increases in labor, weight, material costs, and complexity of assembly. Additionally, such collars need to be closely fitted to the gap between the members if the gap is to be effectively closed, as for example, in ship construction where a watertight intersection may be desired.

One method of tight joining is taught in U.S. Pat. No. 1,805,669 to Liamin. In the '669 patent, the transverse ribs of a metal boat are notched to accommodate continuously running longitudinal members. This allows both transverse and longitudinal members to run continuously, but creates exacting conditions for assembly, in that each structural intersection must be precisely aligned for assembly. Any error in alignment will not only cause a single joint to be misaligned, but the error will be transmitted and amplified along the run of the structural members, and will cause further misalignment.

The third method of intersecting structural members involves making only those members passing parallel to one another continuous, and then fastening intersecting structural members to the sides of the continuous members. This is exemplified in U.S. Pat. No. 1,821,882 to Curr. The '882 patent teaches longitudinal beams welded to the sides of continuous transverse webs. This construction has the advantage of relatively easy assembly and generous assembly tolerances. It has the disadvantage of decreased strength in certain applications when compared to the technique of having all structural members run continuously through intersecting joints. This is particularly true in military shipbuilding where continuous structural members increase the structure's ability to sustain highly dynamic loads.

What continues to be needed but missing from this field of art is a structure and method that combines the advantageous aspects of all of these methods of structural member intersection. An optimal solution would allow the enhanced strength seen when all structural members are continuous, as seen in the overlapping method and the tight and non-tight notching type methods of assembly. The optimal solution would further allow one edge of all structural members to be approximately coplanar, as seen in both the tight and non-tight notching systems, would allow for easy assembly with large tolerances in assembly like the non-tight assembly, and would produce relatively close gaps within the intersecting joint without the addition of collars, as with tight assembly.

The instant invention addresses many of the shortcomings of the prior art and allows for all the heretofore unavailable benefits. Two intersecting structural members are allowed to run continuously, without interruption at the joints where they meet. Because one member passes through another, one edge of each structural member can remain coplanar with an edge of the other structural member, and therefore both members may be fully bonded along one edge to the skin of the structure. The structural members are assembled with an increased ingress area, allowing for wide assembly tolerances, and the ingress area is then easily closed to accomplish a mating of the structural members. This removes the need for collars in non-tight applications. Eliminating the need for collars decreases the number of parts needed, decreases total assembly weight, decreases the amount of welding required, speeds assembly, and contributes excellent resistance to metal fatigue.

SUMMARY OF THE INVENTION

In its most general configuration, the present invention advances the state of the art with a variety of new capabilities and overcomes many of the shortcomings of prior methods in new and novel ways. In particular, the novel use of a keyway and bendable tab replaces the plurality of welding collars needed in prior methods to effectively join structural members when one member passes through a non-tight aperture in another structural member. In its most general sense, the present invention overcomes the shortcomings and limitations of the prior art in any of a number of generally effective configurations.

In one of the many preferable configurations, the intersecting structural member incorporates, among other elements, a first structural member, a second structural member, a predefined keyway formed in the first structural member, an ingress area, and an interlocking joint. Further, the method of joining a first structural member and a second structural member incorporates, among other steps, forming a predefined keyway in the first structural member, bending at least one tab to create an ingress area, passing the second structural member through the ingress area, and interlocking the first and second structural members.

The first structural member may have a first predetermined height and a first predetermined width. Similarly, the second structural member may have a second predetermined height and a second predetermined width. As such, the first and second structural members may be virtually any structural shape, including, but not limited to, tees, channels, bulb flats, I-beams, wide flange beams, and angles having equal or unequal legs.

The first structural member is formed with a predefined keyway having at least one tab. The at least one tab may be bendable about a bending axis. As such, the at least one tab may be bent from a first position, generally an unbend position that is approximately coplanar with the first structural member, to a second position, generally out of the plane of the first structural member. An ingress area is formed when the at least one tab is bent about the bending axis from the first position to the second position, or any location in between, having a predetermined ingress width.

The predetermined ingress width is equal to or greater than the second predetermined width of the second structural member. Therefore, the second structural member may be passed through the ingress area to a location within the keyway to create an interlocking joint. The interlocking joint is created when the at least one tab is bent about the bending axis from the second position back to approximately the first position thereby securing the second structural member to the first structural member by pinching the second structural member against the first structural member.

Forming the predefined keyway may be accomplished in any number of ways. Generally, the predefined keyway is formed by removing material from the first structural member in the shape of the predefined keyway. This may be accomplished through the use of any method by which the first structural member may be cut, ablated, vaporized, or formed. Specialized methods may be required based upon the material of the first structural member.

A majority of applications for this intersecting structural member call for the second structural member to be continuously affixed to a skin panel, while the first structural member is also affixed to the skin panel. Such applications include, but are not limited to, ship and aircraft building. For example, in shipbuilding the second structural member may commonly be continuously welded to a plurality of sheets of steel comprising the hull or deck. Further, the first structural member generally intersects the second structural member at approximately a right angle. In order to maximize the strength of the hull or deck, it is desirable to have as much as possible of the first structural member continuously fastened to the plurality of steel sheets, as well as fastened to the second structural member. The proposed invention allows both the first and second structural members to be welded along essentially their entire lengths to the hull or deck.

The predefined keyway may be formed in any number of geometries to accommodate various shapes of the second structural member. For instance, the second structural member may be a structural tee member having a flange and a stem. In this application, the predefined keyway may include at least a flange engaging region, a stem engaging region, and a seat access region.

Generally, the stem engaging region is formed with at least one tab, and most often with two tabs. In the case of two tabs, one is generally a fixed tab and the other is generally a bendable stem engaging tab. The bendable stem engaging tab is sized such that when the tab is bent about the bending axis from the first position to the second position, an ingress area is formed with a predetermined ingress width equal to or greater than the second predetermined width of the second structural member. The first structural member may then be lowered over the second structural member with the flange passing through the ingress area. Alternatively, if the predetermined ingress width is less than the second predetermined width of the second structural member, the second structural member may be inserted through the first structural member. The method of positioning the structural members is generally through the use of cranes and other power implements. The first structural member may then be positioned so that the stem is in contact with the fixed tab and the first structural member base edge is approximately coplanar with the stem base edge. The bendable stem engaging tab may then be bent about the bending axis back to substantially the first position wedging the stem between the fixed tab and the bendable tab.

The flange engaging region may also include at least one tab. Continuing with the above example, the flange engaging region generally includes one flange engaging tab. The flange engaging tab is bent about a bending axis from a first flange tab position to a second flange tab position thereby increasing the size of the flange engaging region. This is generally performed prior to the positioning of the first structural member. Once the stem has been positioned as described above, the flange engaging tab is bent about the bending axis back to substantially the first flange tab position thereby securing the flange.

The tabs may then be fastened to the second structural member. The fastening may be accomplished by any number of joining methods including, but not limited to, welding, brazing, bolting, and riveting.

The seat access region may be formed in any number of configurations. Generally, the seat access region is continuous from the bending axis of the stem engaging tab throughout the length of the stem fixed tab, and may extend any distance from the first structural member base edge into the first predetermined height. Alternatively, the seat access region may only exist beneath the stem engaging tab and not beneath the stem fixed tab. The seat access region provides a working space allowing welding of the first structural member and second structural member to the skin panel. Additionally, the seat access region facilitates the bending of the stem engaging tab in installations where the skin panel is curved so that the bending of the stem engaging tab is not prematurely limited by the curvature of the skin panel.

In any of the embodiments of the intersecting structural member, the first structural member and the at least one tab may include a tool engaging receptor. The tool engaging receptor is formed to receive a tool for bending the at least one tab. In one particular variation, the tool engaging receptor is located along the bending axis thereby reducing the amount of tab material along the bending axis and therefore reducing the force required to bend the at least one tab. The method of bending must generally be accomplished through the use of a tool. The tool may be manual or electric, pneumatic, hydraulic, or any other power driven variation.

In yet a further variation, the at least one tab may be formed to include a tab material reducing region. The tab material reducing region may be located along the bending axis thereby reducing the tab material along the bending axis and therefore reducing the force required to bend the at least one tab. The tab material reducing region may be formed having virtually any shape.

The force required to bend the at least one tab depends on numerous factors. Among others, these factors include the shape, thickness, and material qualities of the first structural member, the height, width, thickness, and shape of the at least one tab, the degree to which the at least one tab is bent in order to form the ingress area, and the presence and conformation or absence of a tab material reducing region.

These variations, modifications, alternatives, and alterations of the various preferred embodiments, processes, and methods may be used alone or in combination with one another as will become more readily apparent to those with skill in the art with reference to the following detailed description of the preferred embodiments and the accompanying figures and drawings.

BRIEF DESCRIPTION OF THE DRAWINGS

Without limiting the scope of the present invention as claimed below and referring now to the drawings and figures:

Also, in the various figures and drawings, the following reference symbols and letters are used to identify the various elements described herein below in connection with the several figures and illustrations: SP.

DETAILED DESCRIPTION OF THE INVENTION

Figure 6:
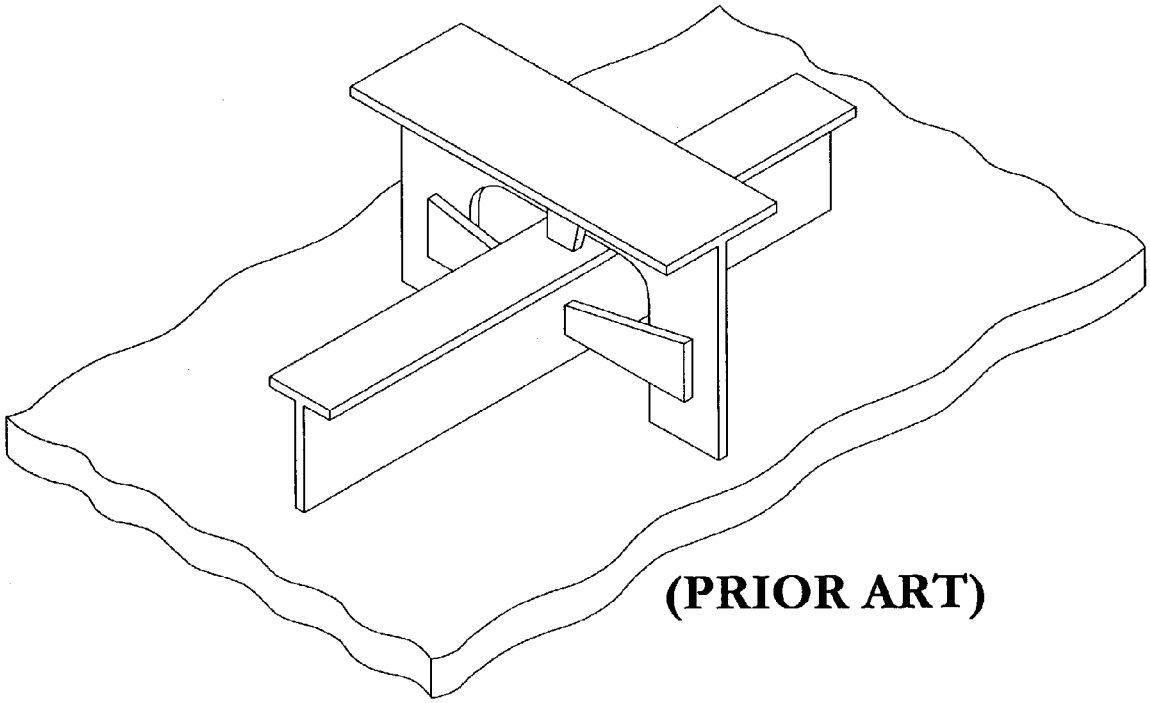
FIG. 6 shows a typical prior art structural intersection used in shipbuilding in elevated perspective view, in reduced scale.

The intersecting structural member and method of joining same of the instant invention enables a significant advance in the state of the art. The preferred embodiments of the apparatus accomplish this by new and novel arrangements of elements and methods that are configured in unique and novel ways and which demonstrate previously unavailable but preferred and desirable capabilities. In particular, the instant invention's use of a keyway and at least one bendable tab replaces the plurality of welding collars needed in prior art methods, as illustrated in FIG. 6, to effectively join structural members, when one member passes through a non-tight aperture in another structural member.

The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

With reference generally now to FIGS. 1 through 12, in one of the many preferable configurations, the intersecting structural member 100 incorporates, among other elements, a first structural member 110, a second structural member 120, a predefined keyway 130 formed in the first structural member 110, an ingress area 160, and an interlocking joint 170. Further, the method of joining a first structural member 110 and a second structural member 120 incorporates, among other steps, forming a predefined keyway 130 in the first structural member 110, bending at least one tab 140 to create an ingress area 160, passing the second structural member 120 through the ingress area 160, and interlocking the first and second structural members 110, 120.

Figure 1:
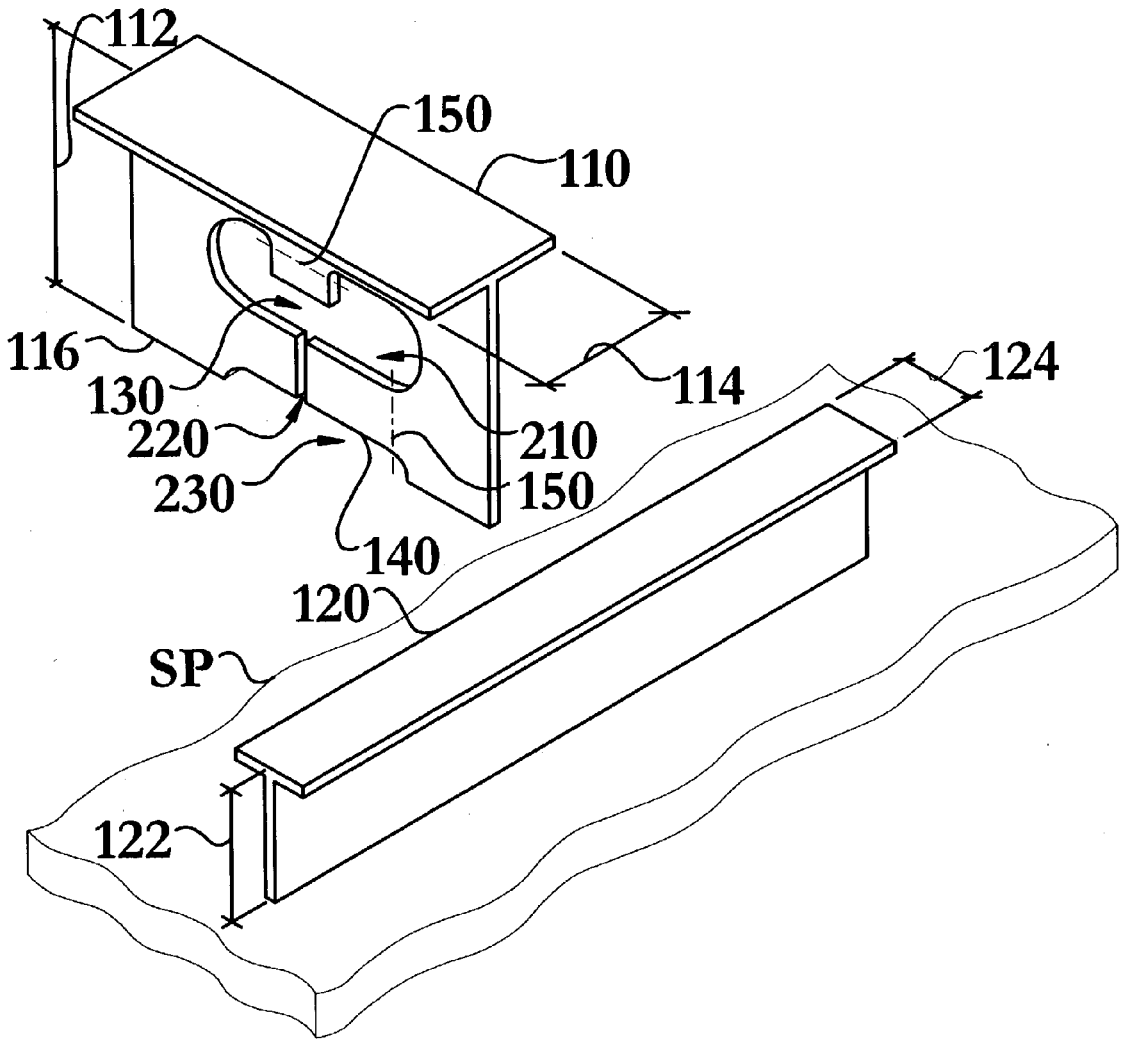
FIG. 1 shows a first structural member and a second structural member used in creating an intersecting structural member wherein the components are shown in elevated perspective view, in reduced scale.
Figure 7:
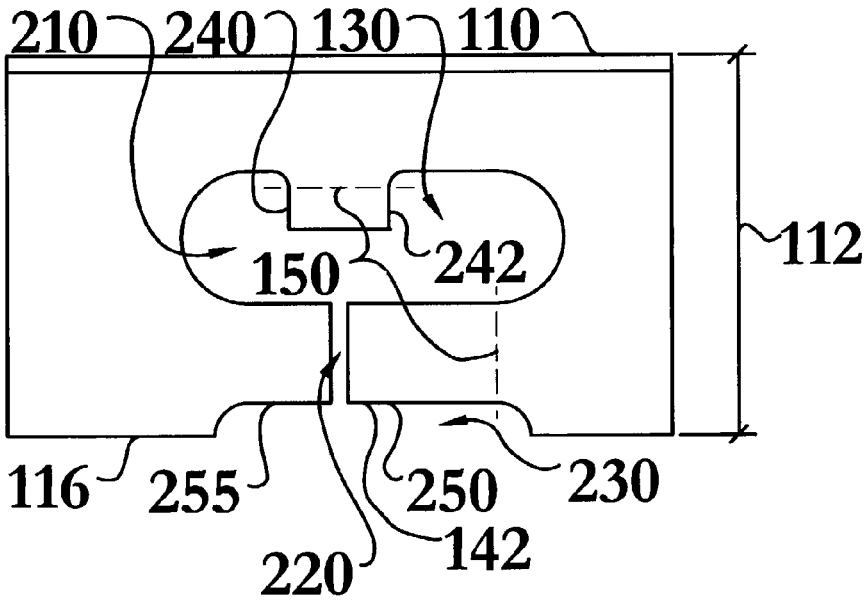
FIG. 7 shows a variation of the first structural member of FIG. 1 in front elevation view, in reduced scale.

Referring now to FIG. 1 and FIG. 7, the first structural member 110 may have a first predetermined height 112 and a first predetermined width 114. Similarly, the second structural member 120 may have a second predetermined height 122 and a second predetermined width 124. As such, the first and second structural members 110, 120 may be virtually any structural shape, including, but not limited to, tees, as illustrated in the associated figures, channels, bulb flats, I-beams, wide flange beams, and angles having equal or unequal legs.

Figure 2:
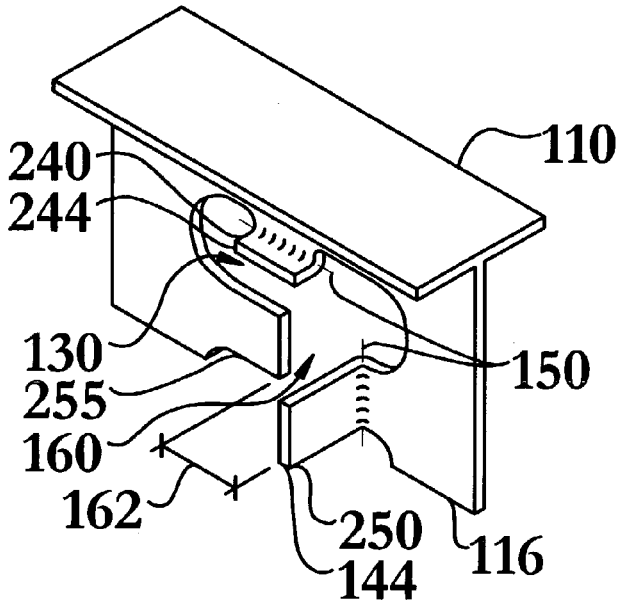
FIG. 2 shows a variation of the first structural member of FIG. 1 in elevated perspective view, in reduced scale.
Figure 8:
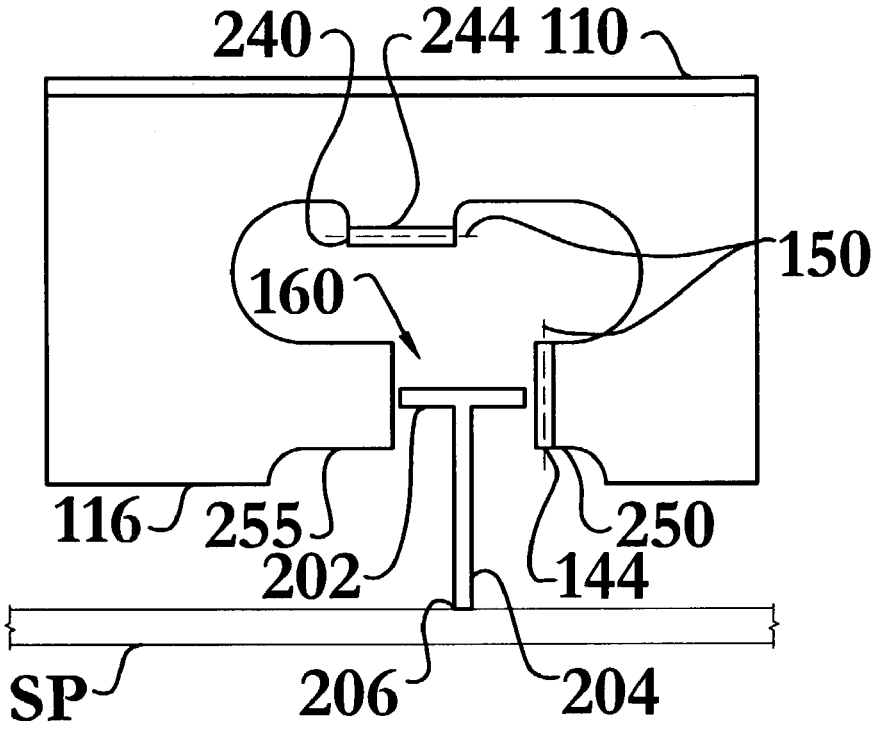
FIG. 8 shows a variation of the first and second structural members of FIG. 1 in front elevation view, in reduced scale.

Referring now to FIG. 2 and FIG. 7, the first structural member 110 is formed with a predefined keyway 130 having at least one tab 140. The at least one tab 140 may be bendable about a bending axis 150. As such, the at least one tab 140 may be bent from a first position 142, generally an unbend position that is approximately coplanar with the first structural member 110 as shown in FIG. 1, to a second position 144, generally out of the plane of the first structural member 110 as shown in FIG. 2 and FIG. 8. An ingress area 160 is formed when the at least one tab 140 is bent about the bending axis 150 from the first position 142 to the second position 144, or any location in between, having a predetermined ingress width 162.

Figure 3:
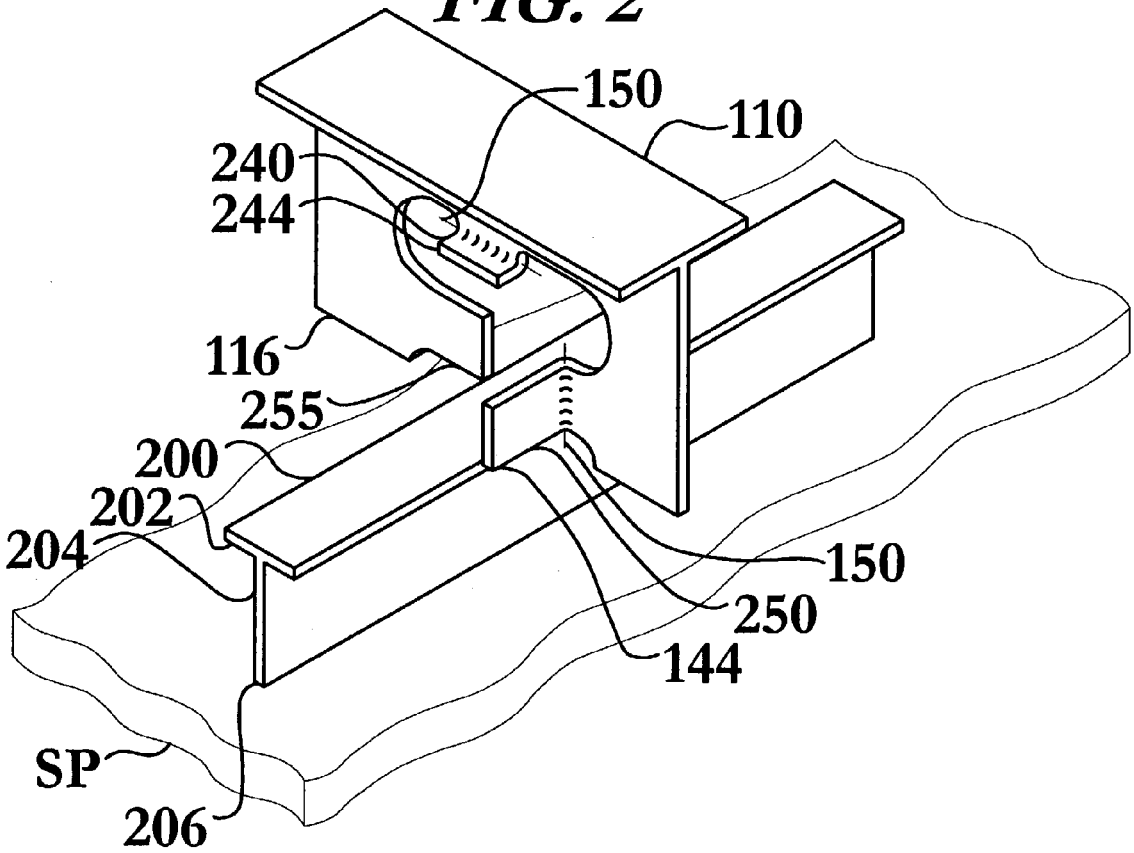
FIG. 3 shows a variation of the first and second structural members of FIG. 1 in elevated perspective view, in reduced scale.
Figure 4:
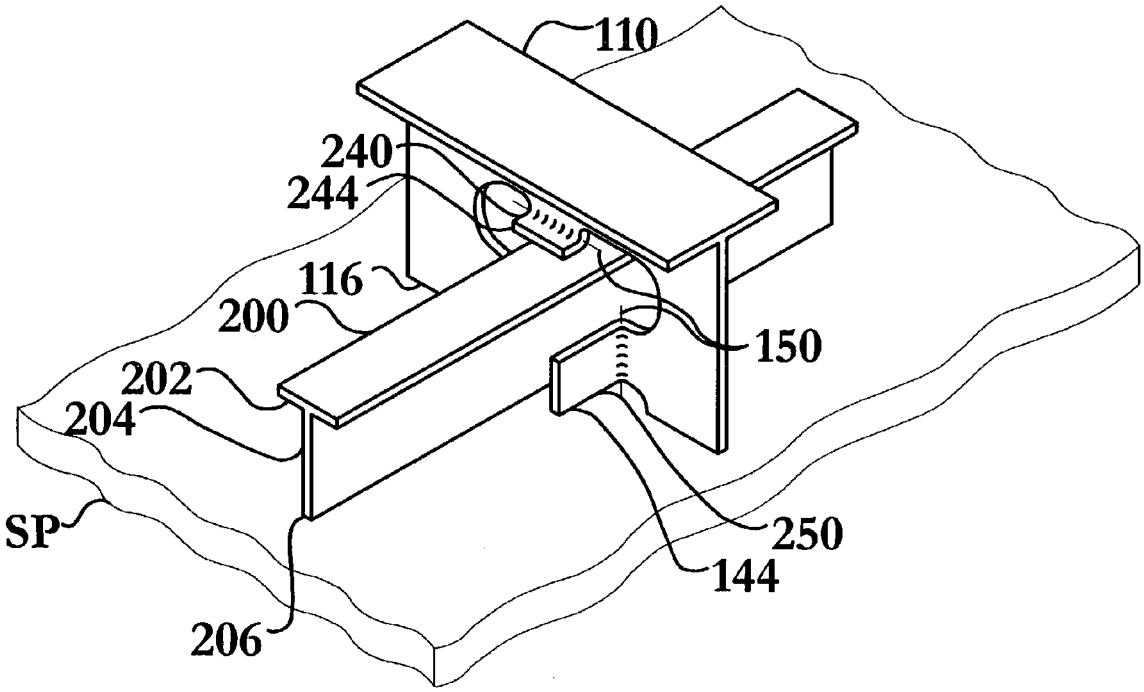
FIG. 4 shows a variation of the first and second structural members of FIG. 1 in elevated perspective view, in reduced scale.

Referring still to FIG. 2, the predetermined ingress width 162 is equal to or greater than the second predetermined width 124, shown in FIG. 1, of the second structural member 120. Therefore, as shown in FIG. 3, FIG. 4, and FIG. 8, the second structural member 120 may be passed through the ingress area 160 to a location within the keyway 130 to create an interlocking joint 170, shown in FIG. 5 and FIG. 10. The interlocking joint 170 is created when the at least one tab 140 is bent about the bending axis 150 from the second position 144 back to approximately the first position 142 thereby securing the second structural member 120 to the first structural member 110 by pinching the second structural member 120 against the first structural member 110.

Forming the predefined keyway 130 may be accomplished in any number of ways. Generally, the predefined keyway 130 is formed by removing material from the first structural member 110 in the shape of the predefined keyway 130. This may be accomplished through the use of any method by which the first structural member 110 may be cut, ablated, vaporized, or formed. Specialized methods may be required based upon the material of the first structural member 110.

A majority of applications for this intersecting structural member 110 call for the second structural member 120 to be continuously affixed to a skin panel SP, while the first structural member 110 is also affixed to the skin panel SP. Such applications include, but are not limited to, ship and aircraft building. For example, in shipbuilding the second structural member 120 may commonly be continuously welded to a plurality of sheets of steel comprising the hull or deck. Further, the first structural member 110 generally intersects the second structural member 120 at approximately a right angle. In order to maximize the strength of the hull or deck, it is desirable to have as much as possible of the first structural member 110 continuously fastened to the plurality of steel sheets, as well as fastened to the second structural member 120. The proposed invention allows both the first 110 and second 120 structural members to be welded along essentially their entire lengths to the hull or deck.

Figure 10:
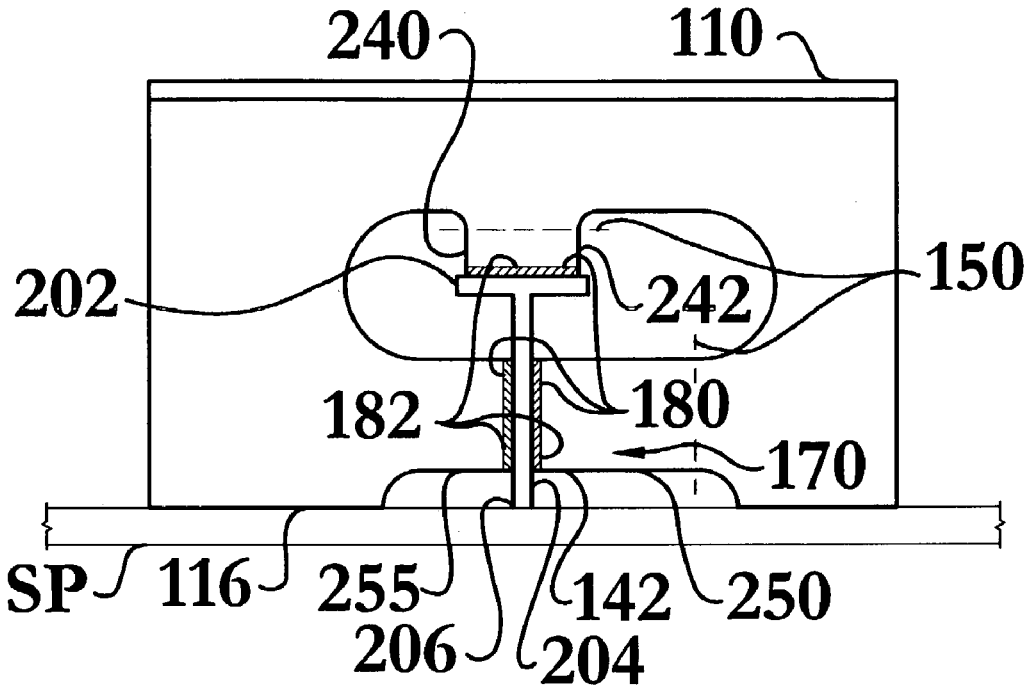
FIG. 10 shows a variation of the first and second structural members of FIG. 1 in front elevation view, in reduced scale.
Figure 11:
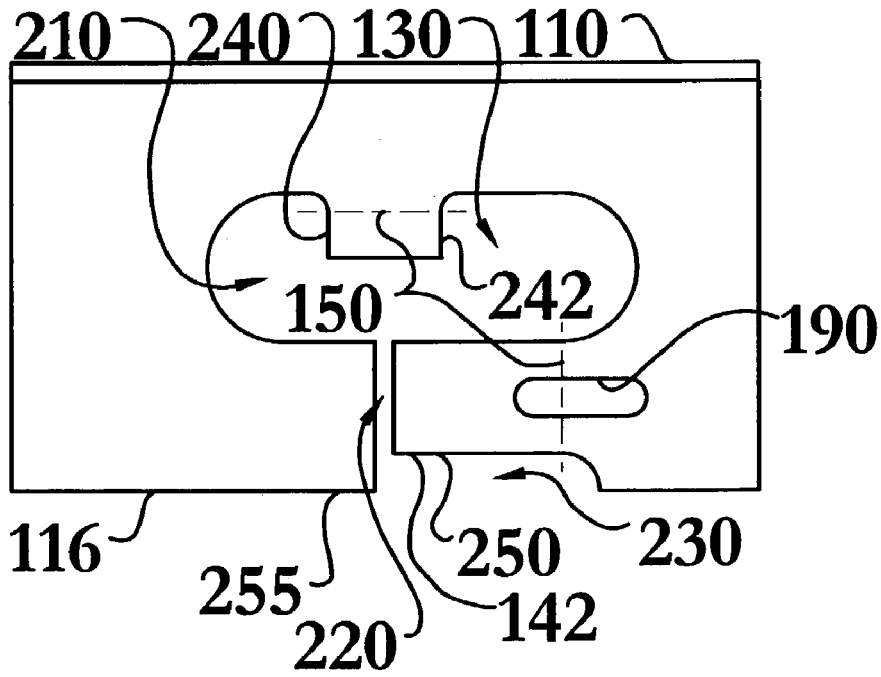
FIG. 11 shows a variation of the first structural member of FIG. 1 in front elevation view, in reduced scale.
Figure 12:
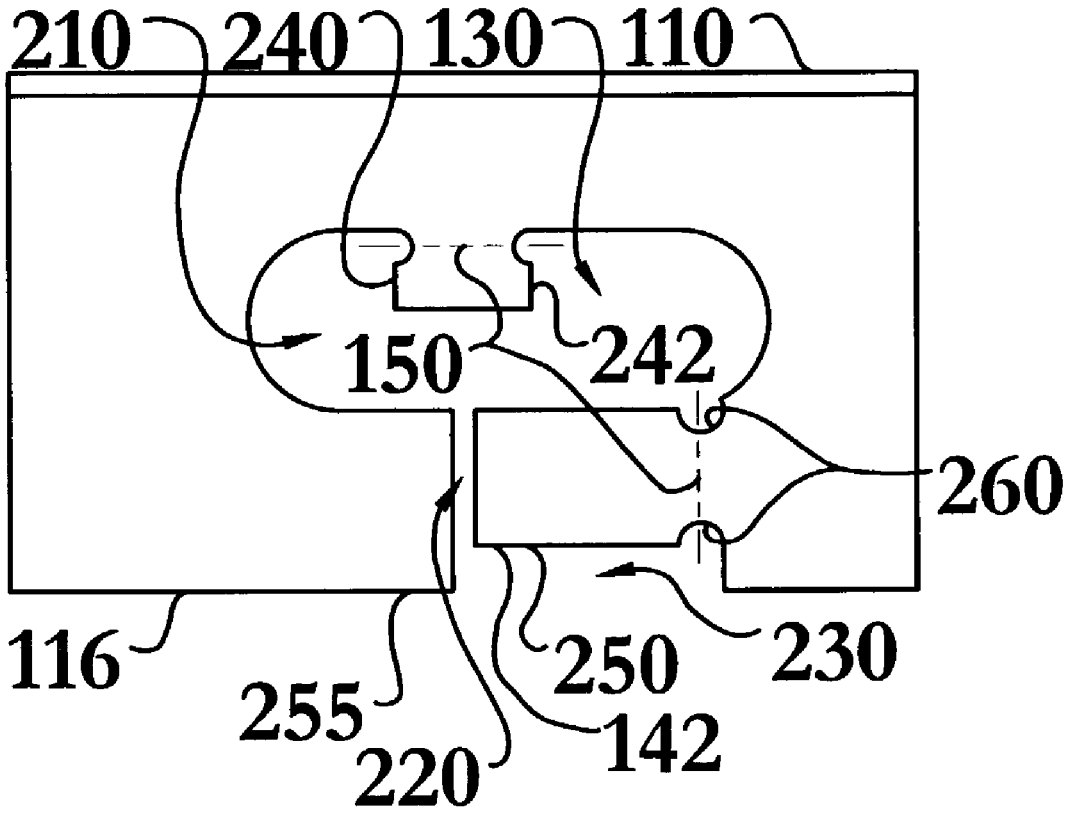
FIG. 12 shows a variation of the first structural member of FIG. 1 in front elevation view, in reduced scale.

The predefined keyway 130 may be formed in any number of geometries to accommodate various shapes of the second structural member 120, as shown in FIG. 10, FIG. 11, and FIG. 12. For instance, the second structural 120 member may be a structural tee 200 member having a flange 202 and a stem 204. In this application, the predefined keyway 130 may include at least a flange engaging region 210, a stem engaging region 220, and a seat access region 230, illustrated best in FIG. 1 and FIG. 7.

Figure 5:
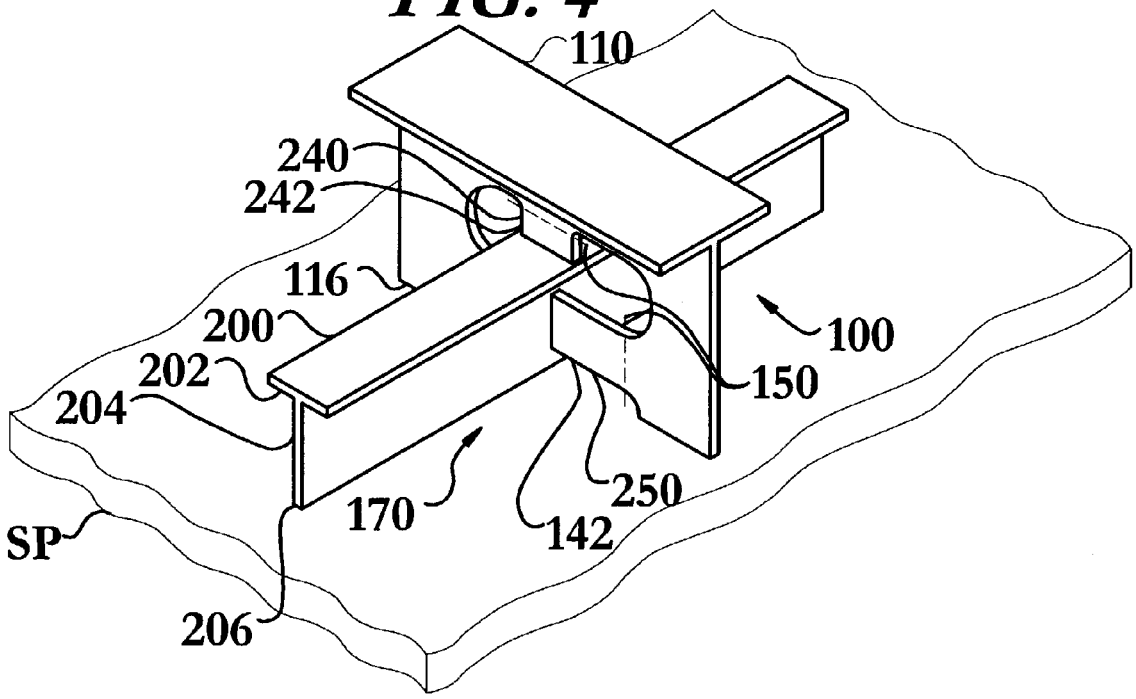
FIG. 5 shows a variation of the first and second structural members of FIG. 1 in elevated perspective view, in reduced scale.
Figure 9:
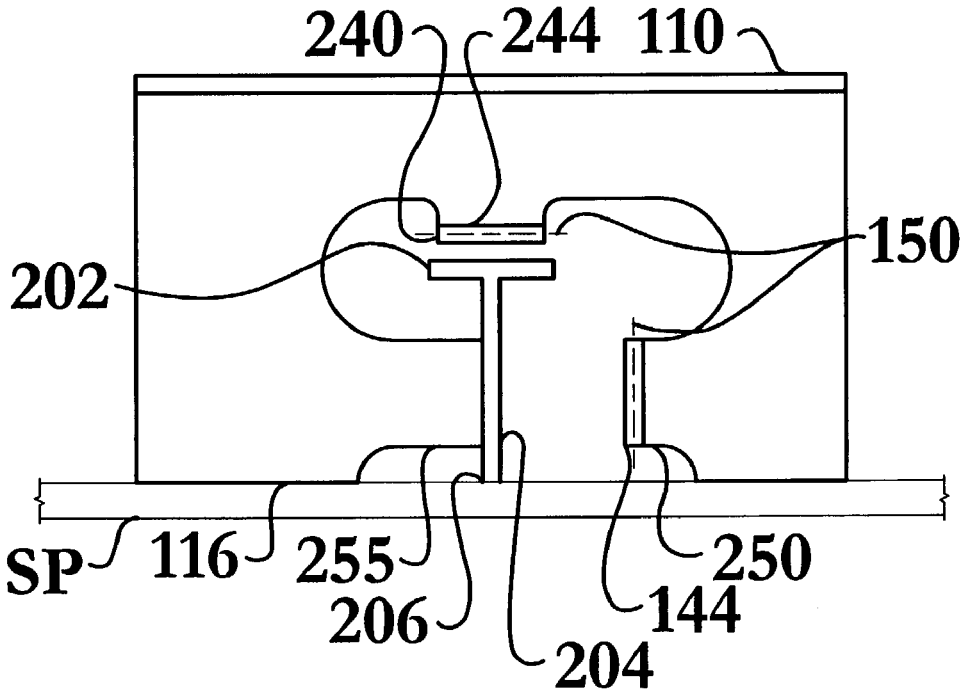
FIG. 9 shows a variation of the first and second structural members of FIG. 1 in front elevation view, in reduced scale.

Referring now to FIG. 1 and FIG. 7, generally, the stem engaging region 220 is formed with at least one tab 140, and most often with two tabs. In the case of two tabs, one is generally a stem fixed tab 255 and the other is generally a bendable stem engaging tab 250. The bendable stem engaging tab 250 is sized such that when the tab is bent about the bending axis 150 from the first position 142 to the second position 144, an ingress area 160 is formed with a predetermined ingress width 162 equal to or greater than the second predetermined width 124 of the second structural member 120, as shown in FIG. 2, FIG. 3, and FIG. 8. The first structural member 110 may then be lowered over the second structural member 120 with the flange 202 passing through the ingress area 160, as shown in FIG. 3, FIG. 4, and FIG. 8. Alternatively, if the predetermined ingress width 162 is less than the second predetermined width 124 of the second structural member 120, the second structural member 120 may be inserted through the first structural member 110. The method of positioning the structural members 110, 120 is generally through the use of cranes and other power implements. The first structural member 110 may then be positioned so that the stem 204 is in contact with the fixed tab 255 and the first structural member base edge 116 is approximately coplanar with the stem base edge 206, as shown in FIG. 5 and FIG. 9. The stem engaging tab 250 may then be bent about the bending axis 150 back to substantially the first position 142 wedging the stem 204 between the stem fixed tab 255 and the stem engaging tab 250, as shown in FIG. 5 and FIG. 10.

As shown best in FIG. 2 and FIG. 7, the flange engaging region 210 may also include at least one tab 140. Continuing with the above example, the flange engaging region 210 generally includes one flange engaging tab 240. The flange engaging tab 240 is bent about a bending axis 150 from a first flange tab position 242 to a second flange tab position 244, illustrated in FIG. 1, FIG. 2, FIG. 7, and FIG. 8, thereby increasing the size of the flange engaging region 240. This is generally performed prior to the positioning of the first structural member 110. Once the stem 204 has been positioned as described above, the flange engaging tab 240 is bent about the bending axis 150 back to substantially the first flange tab position 242 thereby securing the flange 202, shown in FIG. 5 and FIG. 10.

The at least one tab 140 may then be fastened to the second structural member 120 by at least one fastener 180, as shown in FIG. 10. The fastener 180 may be any number of joining methods including, but not limited to, welding 182, brazing, bolting, and riveting.

Referring again to FIG. 7, the seat access region 230 may be formed in any number of configurations. Generally, the seat access region 230 is continuous from the bending axis 150 of the stem engaging tab 220 throughout the length of the stem fixed tab 255, and may extend any distance from the first structural member base edge 116 into the first predetermined height 112. Alternatively, as shown in FIG. 11, the seat access region 230 may only exist beneath the stem engaging tab 250 and not beneath the stem fixed tab 255. The seat access region 230 provides a working space allowing welding of the first structural member 110 and second structural member 120 to the skin panel SP. Additionally, the seat access region 230 facilitates the bending of the stem engaging tab 250 in installations where the skin panel SP is curved so that the bending of the stem engaging tab 250 is not prematurely limited by the curvature of the skin panel SP.

Referring again to FIG. 11, in any of the embodiments of the intersecting structural member 100, the first structural member 110 and the at least one tab 140 may include a tool engaging receptor 190. The tool engaging receptor 190 is formed to receive a tool for bending the at least one tab 140. In one particular variation, the tool engaging receptor 190 is located along the bending axis 150 thereby reducing the amount of tab material along the bending axis 150 and therefore reducing the force required to bend the at least one tab 140. The method of bending must generally be accomplished through the use of a tool. The tool may be manual or electric, pneumatic, hydraulic, or any other power driven variation.

Referring now to FIG. 12, in yet a further variation, the at least one tab 140 may be formed to include a tab material reducing region 260. The tab material reducing region 260 may be located along the bending axis 150 thereby reducing the tab material along the bending axis 150 and therefore reducing the force required to bend the at least one tab 140. The tab material reducing region 260 may be formed having virtually any shape. For purposes of illustration, and not limitation, the tab material reducing region 260 may be formed as a notch in the at least one tab 140 or as an area of reduced thickness of the at least one tab 140.

The force required to bend the at least one tab 140 depends on numerous factors. Among others, these factors include the shape, thickness, and material qualities of the first structural member 110, the height, width, thickness, and shape of the at least one tab 140, the degree to which the at least one tab 140 is bent in order to form the ingress area, and the presence and conformation or absence of a tab material reducing region 260.

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims.

The corresponding structures, materials, acts, and equivalents of all means or step plus function elements in the claims below are intended to include any structure, material, or acts for performing the functions in combination with other claimed elements as specifically claimed.

I claim:

1. An intersecting structural member, comprising:

a first structural member, having a first predetermined height, a first predetermined width, and a first structural member base edge;

a second structural member, having a second predetermined height, which is less than the first predetermined height, a second predetermined width, and a second structural member base edge;

a predefined keyway formed in the first structural member and extending to the first structural member base edge, the predefined keyway having a flange engaging tab bendable about a flange bending axis and a stem engaging tab bendable about a stem bending axis wherein the flange bending axis is substantially parallel to the first structural member base edge;

an ingress area formed when the flange engaging tab is bent about the flange bending axis from a first position to a second position and the stem engaging tab is bent about the stem bending axis from a first position to a second position to receive the second structural member, so that the first structural member base edge and the second structural member base edge are substantially coplanar, and having a predetermined ingress width; and an interlocking joint created when the stem engaging tab is bent about the stem bending axis from the second position to the first position thereby pinching the second structural member against the first structural member and the flange engaging tab is bent about the flange bending axis from the second position to the first position.

2. The intersecting structural member according to claim 1, further including a fastener securing the at least one tab to the second structural member.

3. The intersecting structural member according to claim 2, wherein the fastener is a weld.

4. The intersecting structural member according to claim 1, further including a tool engagement receptor formed in the stem engaging tab.

5. The intersecting structural member according to claim 1, wherein the predetermined ingress width is equal to, or greater than, the second predetermined width.

6. The intersecting structural member according to claim 1, further including at least one tab material reducing region formed at least one of the stem engaging tab and the flange engaging tab.

7. The intersecting structural member according to claim 1, wherein the second structural member is a structural tee member having a flange and a stem.

8. The intersecting structural member according to claim 7, wherein the predefined keyway includes at least a flange engaging region where the first structural member pinches the flange of the second structural member, a stem engaging region where the first structural member pinches the stem of the second structural member, and a seat access region along the first structural member base edge.

9. A method of joining a first structural member, having a first predetermined height, a first determined width, and a first structural member base edge, and a second structural member, having a second predetermined height, which is less than the first predetermined height, a second predetermined width, and a second structural member base edge, the method comprising:

forming a predefined keyway having a flange engaging tab in a first position and a stem engaging tab in a first position in the first structural member, wherein the keyway extends to the first structural member base edge;

bending the flange engaging tab about a flange bending axis, from the first position to a second position, and bending the stem engaging tab about a stem bending axis, from the first position to a second position, wherein the flange bending axis is substantially parallel to the first structural member base edge, thereby creating an ingress area having a predetermined ingress width;

passing the second structural member through the ingress area to mate the first and second structural members; and interlocking the first structural member and the second structural member by bending the stem engaging tab about the stem bending axis from the second position to the first position, such that the first structural member base edge and the second structural member base edge are substantially coplanar, and thereby pinching the second structural member, and bending the flange engaging tab about the flange bending axis from the second position to the first position.

10. The method according to claim 9, further comprising the step of fastening the at least one tab to the second structural member.

11. The method according to claim 10, wherein the step of fastening consists of welding.

12. The method according to claim 9, wherein the stem engaging tab is formed with a tool engagement receptor.

13. The method according to claim 9, wherein the predetermined ingress width is equal to, or greater than, the second predetermined width.

14. The method according to claim 9, further comprising the step of forming at least one tab material reducing region at least one of the stem engaging tab and the flange engaging tab.

15. The method according to claim 9, wherein the second structural member is a structural tee member having a flange and a stem.

16. The method according to claim 15, wherein the predefined keyway includes at least a flange engaging region where the first structural member pinches the flange of the second structural member, a stem engaging region where the first structural member pinches the stem of the second structural member, and a seat access region along the first structural member base edge.

17. The method according to claim 16, wherein the at least one tab includes at least one flange engaging tab and at least one stem engaging tab.

18. A method of joining the structural member of a ship including a first structural member, having a first predetermined height, a first determined width, and a first structural member base edge, and a second structural member, having a second predetermined height, a second predetermined width, and a second structural member base edge, in the method comprising:

forming a predefined keyway having a flange engaging tab in a first position and a stem engaging tab in a first position in the first structural member, wherein the keyway extends to the first structural member base edge;

bending the flange engaging tab about a flange bending axis, from the first position to a second position, and bending the stem engaging tab about a stem bending axis, from the first position to a second position, wherein the flange bending axis is substantially parallel to the first structural member base edge, thereby creating an ingress area having a predetermined ingress width, wherein the predetermined ingress width is equal to, or greater than, the second predetermined width;

passing the second structural member through the ingress area to mate the first and second structural members;

interlocking the first structural member and the second structural member by bending the stem engaging tab about the stem bending axis from the second position to the first position, such that the first structural member base edge and the second structural member base edge are substantially coplanar, and thereby pinching the second structural member, and bending the flange engaging tab about the flange bending axis from the second position to the first position; and fastening the at least one tab to the second structural member.

19. The method according to claim 18, wherein the step of fastening consists of welding.

20. The method according to claim 18, wherein the stem engaging tab is formed with a tool engagement receptor.

21. The method according to claim 18, wherein the second structural member is a structural tee member having a flange and a stem.

22. The method according to claim 21, wherein the predefined keyway includes at least a flange engaging region where the first structural member pinches the flange of the second structural member, a stem engaging region where the first structural member pinches the second structural member, and a seat access region along the first structural member base edge.

23. The method according to claim 21, wherein the at least one tab includes at least one flange engaging tab and at least one stem engaging tab.

* * * * *